US012560061B2

(12) United States Patent
Montilla Jimenez

(10) Patent No.: US 12,560,061 B2
(45) Date of Patent: Feb. 24, 2026

(54) PUMP HAVING HOLLOW ROTOR DISPOSED IN STATOR

(71) Applicant: Schlumberger Technology Corporation, Sugar Land, TX (US)

(72) Inventor: Benigno Segundo Montilla Jimenez, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/659,889

(22) Filed: May 9, 2024

(65) Prior Publication Data

US 2025/0347208 A1 Nov. 13, 2025

(51) Int. Cl.

| | |
|---|---|
| ***E21B 43/12*** | (2006.01) |
| ***F04C 2/107*** | (2006.01) |
| ***F04C 13/00*** | (2006.01) |

(52) U.S. Cl.

CPC ..... *E21B 43/128* (2013.01); *F04C 2/1073* (2013.01); *F04C 13/008* (2013.01); *F04C 2230/603* (2013.01); *F04C 2240/20* (2013.01); *F04C 2240/40* (2013.01)

(58) Field of Classification Search

CPC ..... F04C 2/1071–1078; F04C 18/1075; F04C 13/008; E21B 43/128

See application file for complete search history.

(56) References Cited

U.S. PATENT DOCUMENTS

| | | | | | |
|---|---|---|---|---|---|
| 2,456,227 | A * | 12/1948 | Wade | F04C 2/1073 | 384/129 |
| 2,464,011 | A * | 3/1949 | Wade | F04C 2/084 | 418/48 |
| 2005/0089429 | A1* | 4/2005 | Delpassand | F04C 13/008 | 418/48 |
| 2012/0134861 | A1* | 5/2012 | Akbari | B29C 45/1459 | 164/75 |
| 2019/0093654 | A1 | 3/2019 | Krpec | | |
| 2020/0240248 | A1* | 7/2020 | Abdeldaim | F04C 2/123 | |
| 2020/0362649 | A1* | 11/2020 | Brown | E21B 21/067 | |

FOREIGN PATENT DOCUMENTS

| | | | | |
|---|---|---|---|---|
| CN | 105465377 | A * | 4/2016 | F17C 13/00 |
| CN | 110043227 | A * | 7/2019 | E21B 37/00 |
| DE | 19925106 | A1 * | 12/1999 | F04C 2/1071 |
| EP | 0457925 | A1 * | 11/1991 | F04C 2/1071 |
| GB | 972796 | A * | 10/1964 | F04C 2/1073 |
| WO | WO-2014111082 | A1 * | 7/2014 | F04C 2/1071 |
| WO | 2020037107 | A1 | 2/2020 | |
| WO | 2024081278 | A1 | 4/2024 | |

* cited by examiner

*Primary Examiner* — Laert Dounis
(74) *Attorney, Agent, or Firm* — Jeffrey D. Frantz

(57) ABSTRACT

A system includes an electric submersible progressive cavity pump (ESPCP). The ESPCP includes a stator having an internal bore, and a hollow rotor disposed in the internal bore of the stator, where the hollow rotor is configured to rotate within the internal bore to pump a fluid via a plurality of progressive cavities.

18 Claims, 7 Drawing Sheets

PUMP HAVING HOLLOW ROTOR DISPOSED IN STATOR

BACKGROUND

The present disclosure generally relates to systems and methods for pumping fluid in a subterranean well.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

In many oilfield applications, pumps are deployed downhole to transfer subterranean fluid (e.g., oil) to an above ground location (e.g., collection site). In certain applications, electric submersible pumps (ESPs) are utilized to retain and transfer the subterranean fluid. For example, an ESP may include an electronic motor, encased within a housing, configured to actuate one or more components within the ESP to pump the fluid to the above ground location. As well pressure and fluid volume are reduced, the ESP may lose efficiency, and the probability of mechanical problems may increase. In order to prevent said inefficiencies and complications, operators may transition from the ESP to a low flow system to accommodate for the lower pressure and volumes. However, such low flow systems may not be capable of operating at increased speeds, resulting in reduced efficiency in fluid capture.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a system includes an electric submersible progressive cavity pump (ESPCP). The ESPCP includes a stator having an internal bore, and a hollow rotor disposed in the internal bore of the stator, where the hollow rotor is configured to rotate within the internal bore to pump a fluid via a plurality of progressive cavities.

In certain embodiments, a method includes operating an electric submersible progressive cavity pump (ESPCP), where the ESPCP includes a stator having an internal bore and a hollow rotor disposed in the internal bore of the stator. The method further includes controlling the ESPCP over an operating range between a lower rotational speed to an upper rotational speed of the hollow rotor rotating within the internal bore of the stator, where the upper rotational speed is equal to or greater than 1000 RPM.

In certain embodiments, a method includes assembling a hollow rotor of an electric submersible progressive cavity pump (ESPCP), and installing the hollow rotor within an internal bore of a stator of the ESPCP, where the hollow rotor is configured to rotate within the internal bore to pump a fluid via a plurality of progressive cavities.

The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
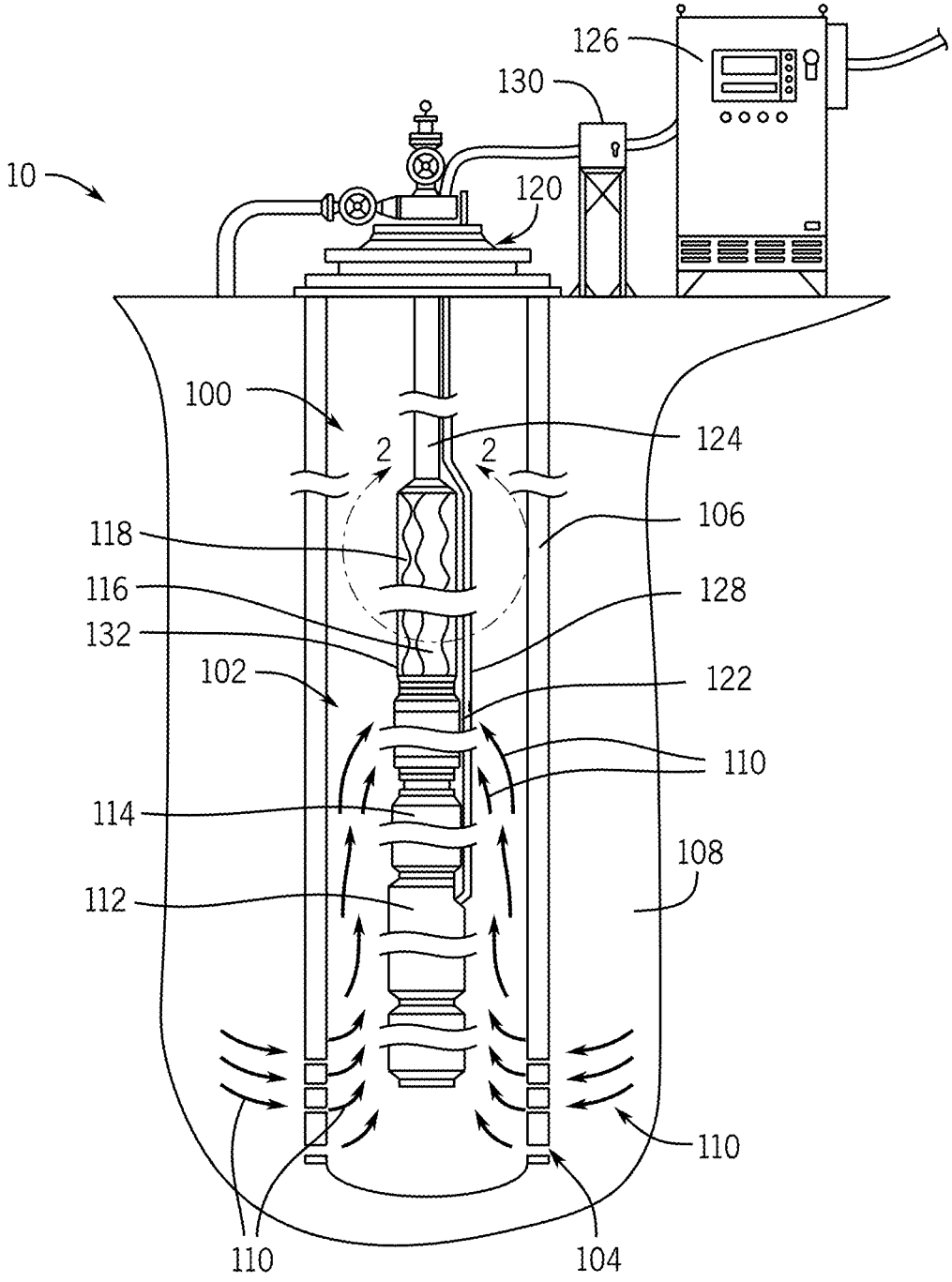
FIG. 1 is a schematic side view of a pump system comprising a pump with a hollow rotor within a stator, in accordance with embodiments described herein.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

In some oilfield operations, recovering subterranean fluid (e.g., liquid oil, natural gas, water, and/or other well fluids) typically includes multiple stages of recovery. Initial stages (e.g., primary stage) may include utilizing the natural pressure of a subterranean oil and gas formation to bias the fluid to the surface. For example, the initial stages of recovery begin as soon as the well is completed (e.g., drilled, encased, etc.) and before additional recovery methods (e.g., artificial lift systems). When the initial stages, such as the natural pressure of the formation, are no longer sufficient to recover the subterranean fluid, secondary measures may be implemented. For example, secondary measures may include artificial lift systems configured to enable fluid to flow to the surface, with artificial mechanical or chemical help. Artificial lift systems may include, gas lifts, ESPs, rod pump systems, water flooding, steam injection, chemical injection, and the like. The use of a certain artificial lift system may depend on one or more factors, such as, the type of fluid (e.g., type of fluid, state of fluid (e.g., gaseous, liquid)), the location of the fluid, formation properties (e.g., rock properties), environmental constraints, regulatory constraints, financial constraints, and the like. Notably, the artificial lift system may be chosen based at least partially on the type of oil (e.g., heavy, light) and the operating temperature (e.g., high-temperature, medium temperature, low temperature).

In one embodiment, an artificial lift system may include an electric submersible progressive cavity pump (ESPCP) system including a stator, a rotor, a motor and optionally a gas separator, configured to recover subterranean fluid for capture on the surface. As will be appreciated, the ESPCP system may be used with similar equipment as an ESP system. For example, the ESPCP may use the same surface equipment as the ESP system, allowing for seamless transition from an ESP system to an ESPCP system. As such, in transitioning between the ESP system and the ESPCP system, the down time may be reduced, further increasing efficiency of the oilfield operation. As will be described in detail below, the ESPCP system may include a rotor (e.g., helical rotor, twisted rotor, threaded rotor, spiraled rotor, coiled rotor), within a stator, configured to rotate upon actuation of the motor to transfer subterranean fluid to an above ground location. Unfortunately, rotation of the rotor may cause undesirable vibrations within the ESPCP system. As such, the ESPCP system may have limited operating capacity (e.g., limited RPMs of the motor and rotor), resulting in limited oilfield operation production. Therefore, the present disclosure relates to a hollow helical rotor configured to reduce the vibrations associated with rotation, resulting in increased operating capacity of the ESPCP system and higher production.

FIG. 1 illustrates an embodiment of a hydrocarbon extraction system 10 having an electric submersible progressive cavity pump system 100 (ESPCP system) positioned in a borehole or wellbore 102. The wellbore 102 may include one or more perforations 104, positioned within an optional casing 106 of the wellbore 102. The perforations 104 may enable fluid 110 (e.g., oil, natural gas, water, or other well fluid) to flow from a surrounding formation 108 (e.g., oil reservoir, subterranean formation) to the wellbore 102. Within the wellbore 102, the fluid 110 may be pumped or otherwise transferred to an above ground location via the ESPCP system 100 for further refining.

The ESPCP system 100 may include one or more components configured to transfer the flow of fluid 110 from the downhole location (e.g., wellbore 102) to the surface. For example, the ESPCP system 100 may include a motor 112 (e.g., submersible motor, permanent magnet motor (PMM)), such as an induction motor or magnetic motor, configured to drive a submersible gearbox 114 positioned on the ESPCP system 100. In embodiments where the motor 112 is a PMM, the ESPCP system 100 may not use of a gear reducer. Further, the use of a PMM may result in reduced interventions (e.g., maintenance interventions) and increased operating capacity (e.g., 100 RPM to 1000 RPM).

The submersible gearbox 114 may be configured to drive a pump 132 (e.g., progressive cavity pump, ESPCP system pump). As will be described in detail below, the pump 132 may include a rotor 116 positioned within a stator 118, configured to transfer fluid 110 from the wellbore 102 to an above ground location. Specifically, as fluid 110 (e.g., oil) flows into the wellbore 102 from the surrounding formation 108 through perforation 104, the motor 112 is configured to drive (e.g., rotate) the rotor 116 within the stator 118 to pump (e.g., transfer) the fluid 110 from the wellbore 102 to a well head 120, a tree, or a combination thereof, and further to an appropriate above ground production location. In some embodiments, the ESPCP system 100 may further include a gas separator (e.g., vortex gas separator assembly or VGSA), configured to separate the fluid 110 into liquid and gas state components. In any case, the fluid 110 may enter the ESPCP system 100 through an intake section 122 (e.g., pump intake), where it may then be transferred through pump 132 and further through a well string or pipeline 124 to the well head 120. For example, the well string or pipeline 124 may be retrievably run through the well head 120 into the wellbore 102. In some embodiments, the ESPCP system 100 may further include additional components such as a gauge (e.g., a downhole gauge) and/or a motor protector. The gauge may be configured to measure one or more properties (e.g., temperature, pressure) of the wellbore 102 and/or parameters of the ESPCP system 100 (e.g., temperature, pressure).

In some embodiments, the ESPCP system 100 may be powered downhole, for example, through a downhole power cartridge. In embodiments where the ESPCP system 100 utilizes an above ground power source, the downhole components (e.g., motor 112) may be powered (e.g., electrically powered) by a power source 126 (e.g., variable speed drive, switchboard). Specifically, the downhole components (e.g., motor 112, gas separator) may be electrically coupled to the power source 126 via, for example, a power line 128. In some embodiments, the power line 128 may be external to the ESPCP system 100, such as, external running through external tubing. In any case, the power line 128 may electrically couple the motor 112 to the power source 126 and a cable junction box 130.

Figure 2:
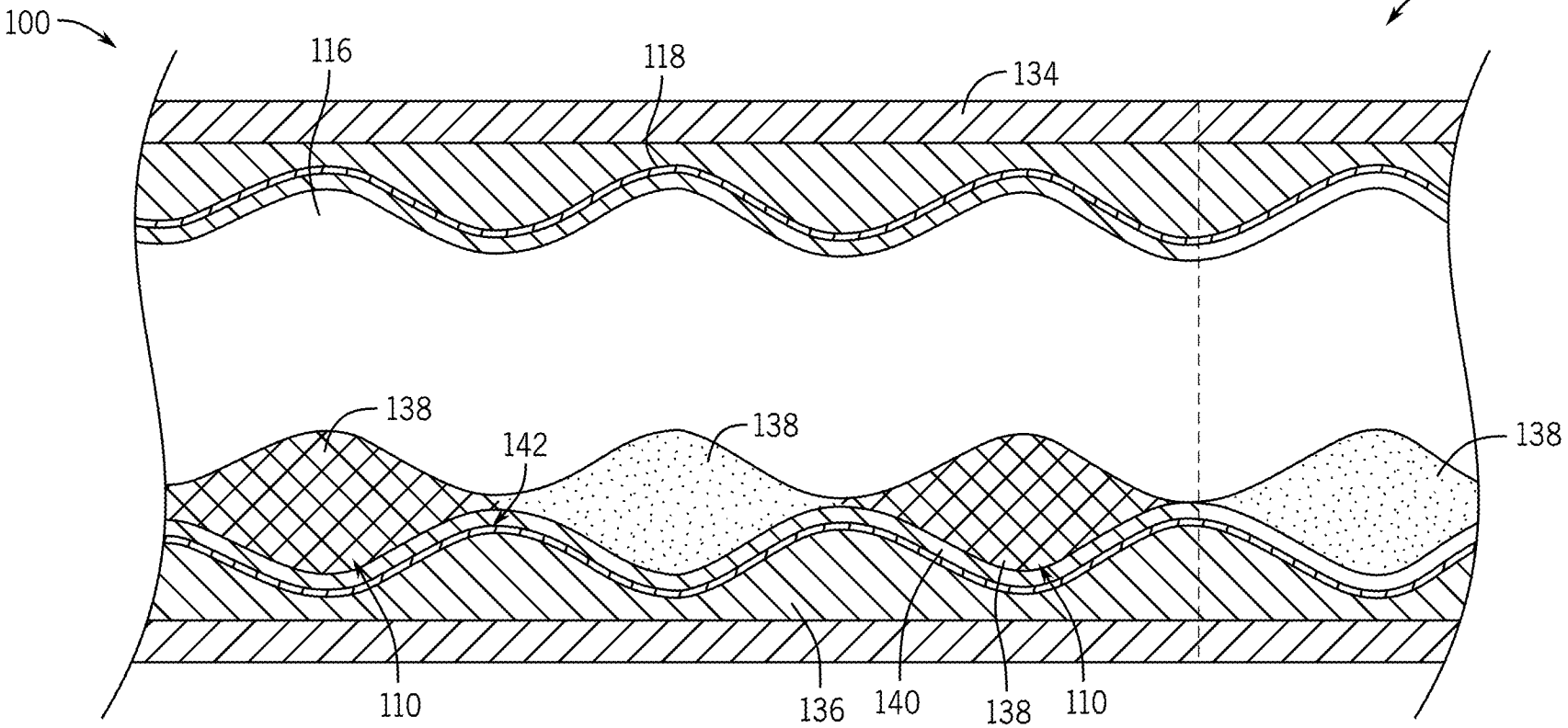
FIG. 2 is a partial cross-sectional side view of the pump of FIG. 1, illustrating the hollow rotor within the stator, in accordance with embodiments described herein.

FIG. 2 illustrates a partial cross-sectional side view of the ESPCP system 100 taken within dashed line 2-2 of FIG. 1, further illustrating details of a pump 132 of the ESPCP system 100 configured to receive and transfer fluid 110 from a downhole location to a surface location. In the illustrated embodiment, the pump 132 may be a progressive cavity pump, including a rotor 116 (e.g., hollow rotor) configured to move fluid within a stator 118 (e.g., composite stator). As discussed in detail below, the rotor 116 (e.g., hollow rotor)

may include a plurality of rotor sections (e.g., hollow rotor sections) and end portions (e.g., rotor head and end cap) coupled together in a series arrangement along a longitudinal axis of the rotor 116 to define a sectioned hollow rotor. Advantageously, the sectioned hollow rotor couples together any number of hollow rotor sections to define a desired axial length of the rotor 116, thereby providing a lightweight rotor 116 that is resistant to vibration and operable at higher rotational speeds than a corresponding solid rotor. The composite construction of the stator 118 also enhances the operational characteristics of the pump 132, such as by increasing strength, reducing weight, reducing vibration, or any combination thereof. As a result of the hollow rotor 116 and the composite stator 118, the pump 132 is able to operate over a wide range of rotational speeds, rather than requiring different pumps at different rotational speeds (e.g., low speed pump at low speeds and a high speed pump at high speeds). Additionally, the pump 132 provides one or more additional features (e.g., vortex gas separator) over a wide range of rotational speeds, such as between 0 to 1500 RPM, 10 to 1400 RPM, 20 to 1300 RPM, 30 to 1200 RPM, 40 to 1100 RPM, or 50 to 1000 RPM.

The stator 118 may be radially encapsulated within outer housing 134 (e.g., annular outer housing or wall), where the outer housing 134 may include a durable material, such as metal (e.g., steel, iron, titanium). Within the outer housing 134, the ESPCP system 100 may include a first layer 136 including or made of a composite material having a plurality of reinforcing elements (e.g., particles, fibers, etc.) distributed in a matrix material. The matrix material may include a polymer (e.g., a thermoset resin, epoxy, vinyl ester, or polyester thermosetting plastic), a ceramic, or a combination thereof. The reinforcing elements may include particles and/or fibers of metal, carbon, glass, aramid, or any combination thereof. The first layer 136 may be shaped (e.g., threaded) to correspond to a respective shape of the rotor 116 (e.g., spiral or helical shape). For example, the first layer 136 may be manufactured as an internal thread (e.g., threading 142) to enable progressive cavities 138 to be formed from the spiral or helical shape of the rotor 116 and the first layer 136. By further example, the first layer 136 may alternatingly expand and contract in cross-sectional area lengthwise along a longitudinal axis of the stator 118. The first layer 136 may be coupled to the outer housing 134 by any suitable connection, for example, welding, chemical adhesives, and the like. In some embodiments, the first layer 136 may be one integral piece with the outer housing 134.

In an embodiment, the ESPCP system 100 may include a second layer 140 that may be coupled to the first layer 136 via the threading 142. The second layer 140 may include the same shape as the first layer 136 (e.g., shape configured to correspond with spiral or helical shape of rotor 116 during rotation, threaded). In some embodiments, the second layer 140 may be constructed of an elastomer (e.g., nitrile rubber (NBR), hydrogenated nitrile rubber (HNBR), fluoroelastomer). In this way, the second layer 140 may include reduced thermal expansion due to downhole environmental factors and/or thermal energy creating from the rotation of rotor 116 within the stator 118. In any case, the spiral or helical shape of the rotor 116 and the threaded shape of the stator 118 (e.g., second layer 140, first layer 136), may be configured to define one or more progressive cavities 138. The said progressive cavities 138 may be configured to retain and move (e.g., transfer) fluid 110 from the wellbore 102 to an above ground location (via the pipeline 124) during rotation of the rotor 116 relative to the stator 118.

Figure 3:
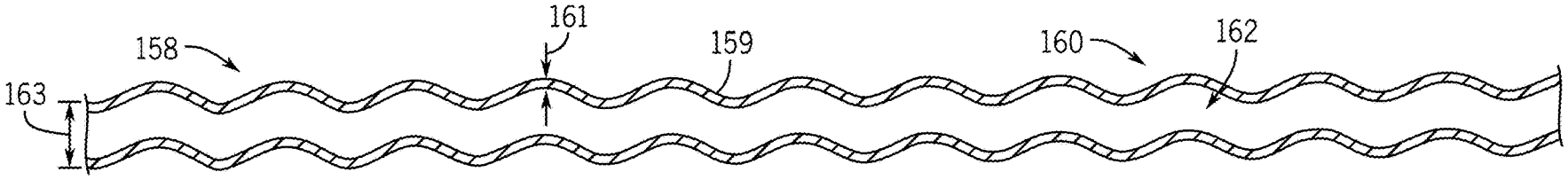
FIG. 3 is a cross-sectional side view of the hollow rotor of FIGS. 1 and 2, in accordance with embodiments described herein.

FIG. 3 illustrates a cross-sectional side view of an embodiment of a rotor 116 (e.g., a hollow rotor 158) that may be used in an embodiment of the ESPCP system 100 as illustrated in FIGS. 1 and 2. It should be noted that rotor 116 and hollow rotor 158 may be used interchangeably within an ESPCP system 100. As discussed above, the hollow rotor 158 may rotate (e.g., rotate from the motor 112) relative to the stator 118 to define progressive cavities 138 configured to transfer fluid 110 from the wellbore 102 to an above ground location. In the illustrated embodiment, the hollow rotor 158 may be carved out (e.g., hollow interior), enabling an overall reduced weight of the hollow rotor 158. That is, the hollow rotor 158 may include an outer shell 160 surrounding an interior space 162 (e.g., void, hollowed space, or interior chamber). The interior space 162 may be empty, under vacuum, and/or filled with a gas (e.g., air, inert gas such as nitrogen, etc.). The outer shell 160 may include a spiral or helical shaped outer wall 159 having a thickness 161 and an outer diameter 163, wherein the thickness 161 may be determined based on the outer diameter 163. For example, the thickness 161 may be less than or equal to approximately 5, 10, 15, or 20 percent of the outer diameter 163. In some embodiments, the thickness 161 may range between approximately 5 to 50 mm depending on the outer diameter 163 and the overall axial length of the hollow rotor 158. Additionally, the outer shell 160 may be constructed from a suitable metal, such as stainless steel, having chemical resistance and/or wear resistant suitable for use in downhole operations.

The hollow rotor 158 may include a reduced weight, relative to traditional rotors (e.g., solid rotor), while still maintaining the desired shape (e.g., spiral or helical shape), size (e.g., diameter, length), and durability (e.g., thermal resistance, wear resistance). As the hollow rotor 158 rotates, the ESPCP system 100 may experience reduced vibrations associated with the eccentric (e.g., uncentered) movement of the hollow rotor 158 (e.g., due to the spiral or helical shape). As such, the ESPCP system 100 may experience less interventions (e.g., maintenance interventions) due to wear (e.g., damage) from increased vibrations, therefore increasing efficiency of the ESPCP system 100. Further, the hollow rotor 158 may include an improved lifetime (e.g., increased lifetime relative to traditional rotors), due to the reduced wear. As will be appreciated, the hollow rotor 158 may enable the ESPCP system 100 to operate at increased capacities. For example, the motor of the ESPCP system 100 may operate at an increased RPM, such as up to at least equal to or greater than 500 RPM, 600 RPM, 700, RPM, 800 RPM, 900 RPM, 1000 RPM, 1100 RPM and so forth. In this way, an increased amount of fluid (e.g. oil) may be captured from a below ground location (e.g., the subterranean formation), increasing the efficiency and productivity of the ESPCP system 100. The hollow rotor 158 also enables the pump 132 of the ESPCP system 100 to operate over a wider range of rotational speeds, such that the pump 132 can operate at low speeds or high speeds as needed without requiring different pumps 132.

In some embodiments, the hollow rotor 158 may be formed through hydroforming methods. For example, a material (e.g., metal) may be shaped due to the application of a high-pressure hydraulic fluid and a mold. In the present instance, high pressure hydraulic fluid may be applied to the outer shell 160 to shape the outer shell 160 to a spiral or helical shape while also creating the interior space 162. In other embodiments, the hollow rotor 158 may be manufactured by any desirable and/or suitable method, such as additive manufacturing, casting, bending, molding and/or welding. Additionally, the hollow rotor 158 may be formed by coupling together a plurality of hollow rotor sections to define a desired overall length of the hollow rotor 158.

In an embodiment, the hollow rotor 158 may include a variable width (e.g., outer diameter 163) along the axial length of the hollow rotor 158. That is, a width (e.g., outer diameter 163) may increase or decrease (e.g., increase or decrease by 0.1 in, 0.2, inch, 0.3 in, 0.4 inches, 0.5 inches, 0.6 inches, 0.7 inches, etc.) along the axial length (e.g., from a discharge portion to an intake portion) of the hollow rotor 158. In this way, the hollow rotor 158 may increase temperature stability within the ESPCP system 100, increase control of slippage between the hollow rotor 158 and the stator 118, and may compensate for compressed gas.

Figure 4:
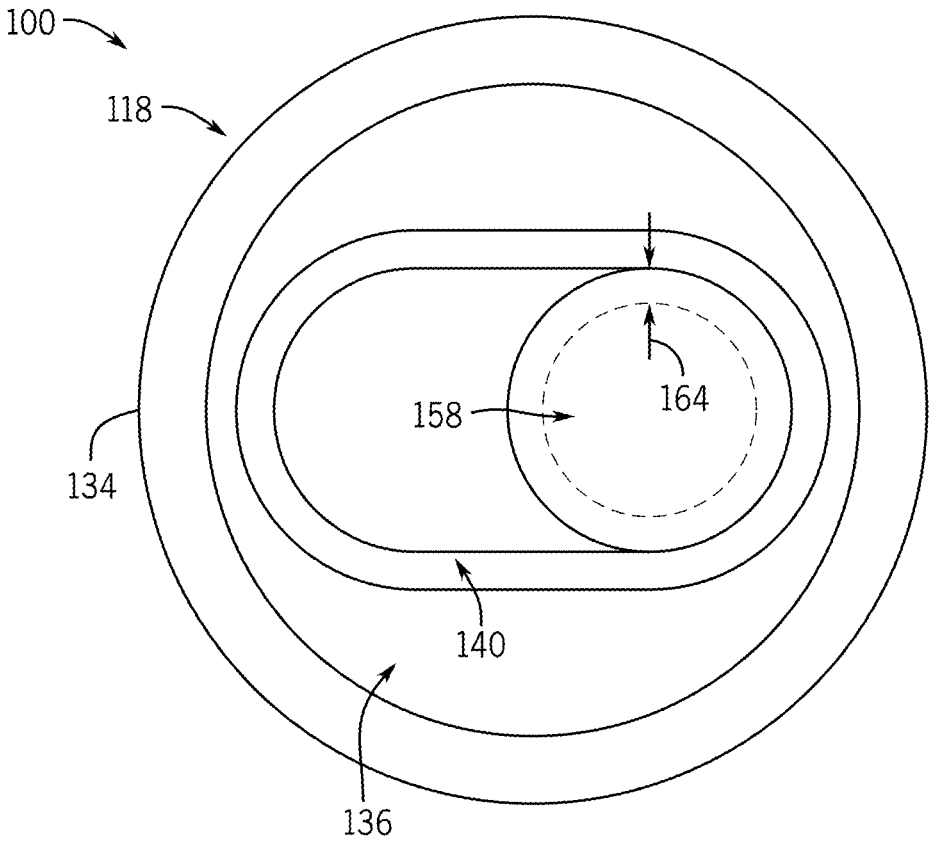
FIG. 4 is a cross-sectional end view of the pump of FIGS. 1 and 2, illustrating the hollow rotor within the stator, in accordance with embodiments described herein.

FIG. 4 illustrates a cross-sectional end view of an embodiment of the hollow rotor 158 and the stator 118 of the pump 132 of FIGS. 1-3. As discussed above, the stator 118 may include an outer housing 134, a first layer 136 and a second layer 140, encapsulating the hollow rotor 158. The outer housing 134 may include any desired material suitable for downhole application, such as carbon steel, stainless steel, ni-resist (e.g., ni-resist alloy, cast iron alloy), nickel alloys, and/or other suitable materials. The outer housing 134 may have any thickness desirable and/or suitable for downhole applications. In some embodiments, the outer housing 134 thickness may depend on or may at least partially be based on the type of material the outer housing 134 is constructed from.

The first layer 136 may include any desired material suitable for downhole application, such as a composite material having a plurality of reinforcing elements (e.g., particles, fibers, etc.) distributed in a matrix material. For example, the matrix material may include a polymer (e.g., a thermoset resin, epoxy, vinyl ester, or polyester thermosetting plastic), a ceramic, or a combination thereof. By further example, the matrix material may include bismaleimide, cyanate esters, preceramic thermosets, phenolics, novalacs, dicyclopentadiene-type systems or other thermoset materials. Additionally, the reinforcing elements may include particles and/or fibers of metal, carbon, glass, aramid, or any combination thereof. In some embodiments, the composite material may include various additives to enable improved heat dissipation in the stator 118. For example, the reinforcing elements and/or the additives may include mineral particles, metal powder, ceramic particles, organic particles, silica, alumina fillers, aluminum metal particles and/or other suitable additives. In this way, the first layer 136 may experience reduced negative effects of increased thermal energy due to the downhole environment and/or operating parameters. As discussed above, the first layer 136 may include a threaded shape complimentary to the spiral or helical shape of the hollow rotor 158.

The second layer 140 may also include any desired material suitable for downhole application, such as an elastomer. For example, the second layer 140 may include nitrile rubber (NBR), hydrogenated nitrile rubber (HNBR), fluoroelastomer and/or other suitable materials. In this way, the second layer 140 may include a higher strength, compared to traditional stators, to provide increased resistance to damage. Further, the second layer 140 may experience reduced negative effects (e.g., undesirable expansion) of increased thermal energy due to the downhole environment and/or operating parameters. As discussed above, the second layer 140 may include a threaded shape complimentary to the spiral or helical shape of the hollow rotor 158. During rotation of the hollow rotor 158 relative to the second layer 140, progressive cavities may retain and transport fluid (e.g., oil) from a downhole location to a suitable above ground location. As such, the second layer 140 may include any suitable material to withstand contact with the fluid and contact with the hollow rotor 158.

As discussed above, the ESPCP system 100 may also include the hollow rotor 158 configured to rotate within the stator 118 (e.g., the second layer 140 of the stator 118). In doing so, the progressive cavities defined by the second layer 140 and the hollow rotor 158 may retain and transport fluid (e.g., oil) from the wellbore to an above ground location. As will be appreciated, the lack of interior material (e.g., core material) within the hollow rotor 158 substantially reduces the weight and vibration associated with the hollow rotor 158 and the overall ESPCP system 100. As such, during rotation of the hollow rotor 158 by a motor (e.g., permanent magnetic motor (PMM)), a reduced vibration may be observed over a wide range of rotational speeds. Specifically, the vibration (e.g., velocity of vibration (mm/s)) associated with rotating a spiral or helical shaped rotor may be reduced (e.g., reduced by at least equal to or greater than 50%, 60%, 70%, etc.) with the reduced weight of the hollow rotor 158 as compared to a solid rotor having a similar geometry and material construction. In this way, the hollow rotor 158 may rotate within the stator 118 at speeds (e.g., at least equal to or greater than 500 RPM, 600 RPM, 700 RPM, 800 RPM, 900 RPM, 1000 RPM) greater than traditional rotors (e.g., solid rotors). For example, as a benefit of the hollow rotor 158 and the composite construction of the stator 118, the pump 132 may be configured to operate over a wide range of rotational speeds, such as between 0 to 1500 RPM, 10 to 1400 RPM, 20 to 1300 RPM, 30 to 1200 RPM, 40 to 1100 RPM, or 50 to 1000 RPM. The thickness 164 of the outer shell 160 may be any thickness suitable to reduce the weight associated with the hollow rotor 158 while still maintaining structural durability. In some embodiments, the thickness 164 may depend on or may at least partially be based on the material of the hollow rotor 158.

Figure 5:
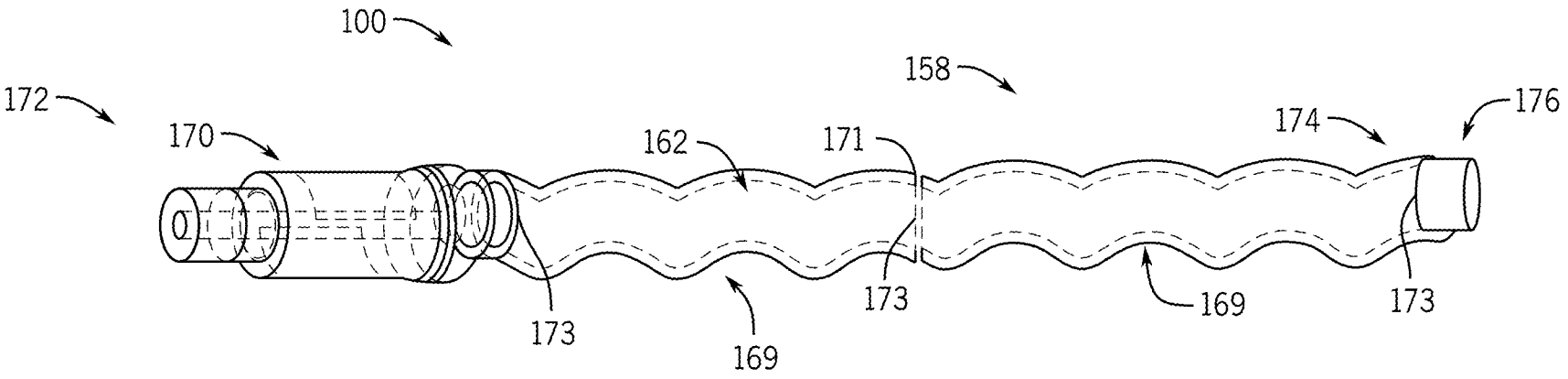
FIG. 5 is a perspective view of the hollow rotor of FIGS. 1-4, illustrating a rotor head and a cap, in accordance with embodiments described herein.

FIG. 5 illustrates an embodiment of the hollow rotor 158 having a plurality of hollow rotor sections 169 between a rotor head 170 (e.g., rotor connection) proximate a first end 172 of the hollow rotor 158 and a cap 174 proximate a second end 176 of the hollow rotor 158. In the illustrated embodiment, the hollow rotor 158 includes two of the hollow rotor sections 169; however, the hollow rotor 158 may include at least 2, 3, 4, 5, 6, 7, 8, 9, 10 or more hollow rotor sections 169 coupled together in a series arrangement between the rotor head 170 and the cap 174. The hollow rotor sections 169 may be coupled together at intermediate joints 171, such as axial end faces coupled together via a welded joint. The hollow rotor sections 169 may be generally open at opposite axial ends 173, and thus adjacent hollow rotor sections 169 are internally open to one another (e.g., interior chambers are coupled together). However, the rotor head 170 and the cap 174 generally close the axial ends 173 of the hollow rotor sections 169 at the axially opposite ends (e.g., 172 and 176) of the hollow rotor 158.

The rotor head 170 may be configured to couple the hollow rotor 158 to a shaft (e.g., flexible shaft) of a motor (e.g., PMM). In this way, the rotation of the shaft by the motor may further rotate the hollow rotor 158 within the stator in a manner as described in detail above. Further, the hollow rotor 158 may include the cap 174 configured to seal the interior space 162 from the exterior environment. The rotor head 170 may also be configured to seal the interior space 162 from the exterior environment. In this way, the cap 174 and the rotor head 170 may seal the hollow rotor 158, reducing any increase of fluids and/or particulates into the interior space 162, thereby further reducing vibrations associated with rotation of the hollow rotor 158. The rotor head 170 and the cap 174 may include any suitable material, such as stainless steel, metal composites, and/or other suitable materials. The rotor head 170 and the cap 174 may also be coupled to the hollow rotor 158 in any suitable manner, for example, welding, mechanically (e.g., bolts, screws, fasteners, etc.), chemically (e.g., adhesives), and/or any other suitable method.

Figure 6:
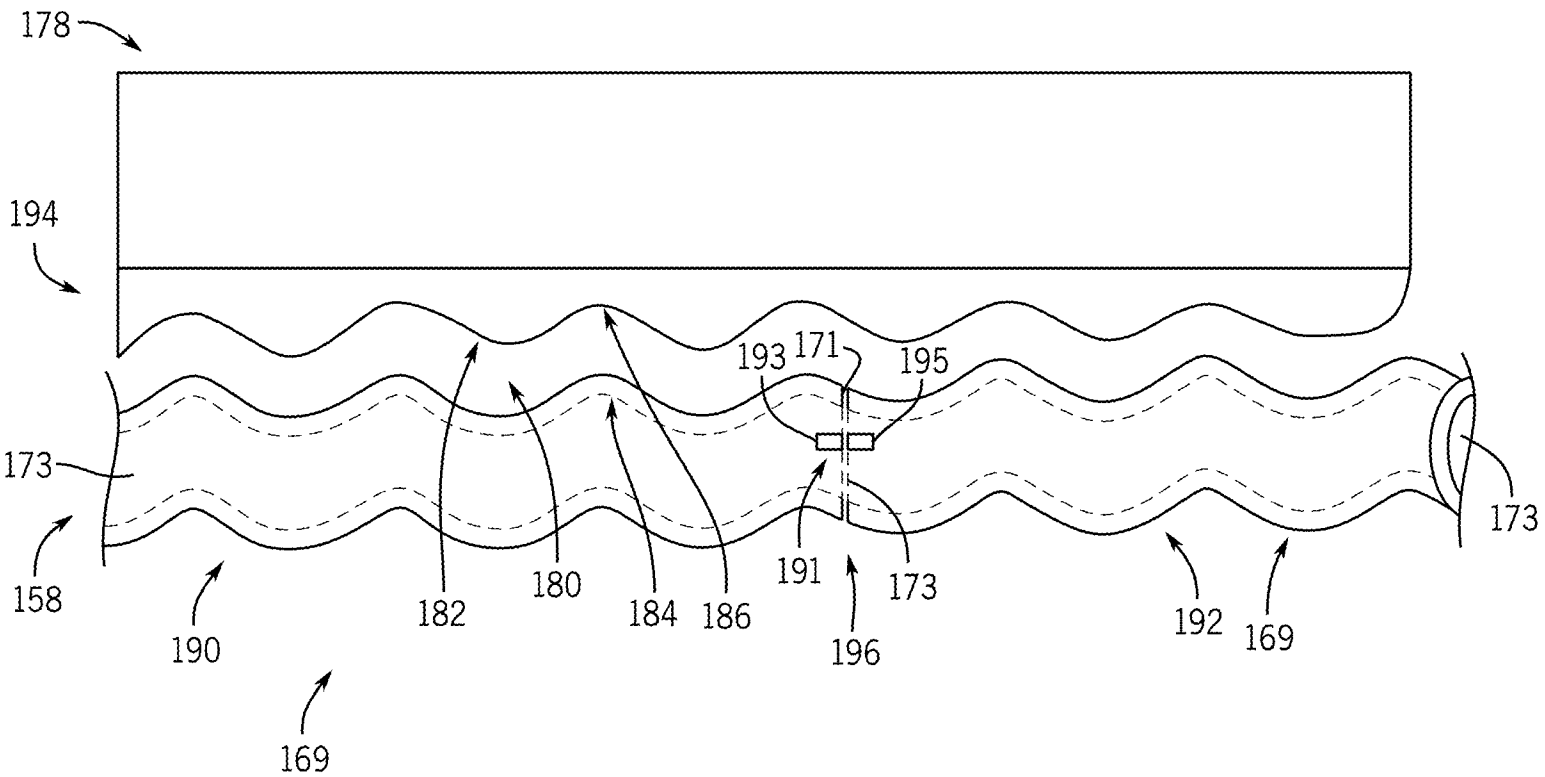
FIG. 6 is a side view of an alignment tool for aligning and joining hollow rotor sections of the hollow rotor of FIGS. 1-5, in accordance with embodiments described herein.

FIG. 6 illustrates an embodiment of an alignment tool 178 adjacent to multiple hollow rotor sections 169 of the hollow rotor 158, wherein the alignment tool 178 aligns the hollow rotor sections 169 in proper relative positions for connecting the hollow rotor sections 169 at the intermediate joints 171. In some embodiments, the hollow rotor sections 169 of the hollow rotor 158 may be coupled together in a series arrangement to increase the length of the hollow rotor 158. For example, the hollow rotor sections 169 may include a first section 190 coupled to a second section 192. In some embodiments, the first section 190 and the second section 192 of the hollow rotor 158 may be coupled by welding the sections together at the intermediate joint 171. However, coupling of the first section 190 and the second section 192 may include any suitable connector, such as bolted flanges with seals, clamps, brazed joints, or any combination thereof. Additionally, any number of the hollow rotor sections 169 may be coupled together in series at respective intermediate joints 171 using the alignment tool 178 for proper relative alignment between the hollow rotor sections 169.

In any case, in order to align the first section 190 and the second section 192, the alignment tool 178 may be utilized. The alignment tool 178 may include an alignment side 194, with one or more alignment troughs 186 and one or more alignment crests 182 (e.g., defining a wave pattern or sinusoidal pattern conforming to the spiral or helical shape of the hollow rotor 158). In an embodiment, the one or more alignment troughs 186 and the one or more alignment crests 182 may correspond to one or more rotor crests 184 and one or more rotor troughs 180, respectively. That is, each alignment trough of the one or more alignment troughs 186 may include a depth, width, and/or curved shape that may correspond to a respective rotor crest 184 including a height, width, and/or curved shape. Similarly, each alignment crest of the one or more alignment crests 182 may include a height, width, and/or curved shape that may correspond to a respective rotor trough 180 including a depth, width, and/or curved shape. In some embodiments, each of the hollow rotor sections 169 may include alignment indicia or keys 191, such as alignment indicia or keys 193 and 195 on opposite ends of each of the hollow rotor sections 169. These alignment indicia or keys 191 (e.g., 193 and 195) may be used to properly align the hollow rotor sections 169 when coupling together the hollow rotor sections 169 at the intermediate joints 171. These alignment indicia or keys 191 (e.g., 193 and 195) may be used alone or in combination with the alignment tool 178.

In the illustrated example, the first section 190 may be aligned and coupled with a second section 192 to create a desired length of the hollow rotor 158. Specifically, an end portion of the first section 190 and an end portion of the second section 192 may be positioned to contact one another at a contact point 196. The alignment tool 178 may be positioned over (e.g., overlapping) the contact point 196 and at least a portion of the first section 190 and at least a portion of the second section 192. The first section 190, the second section 192, or both, may then be rotated (e.g., axially rotated along an axis extending through a length of the first section 190, the second section 192, or both) until each rotor crest (e.g., each rotor crest positioned to be aligned with the alignment side 194) of the first section 190 and the second section 192 are aligned with each respective alignment trough 186 of the alignment tool 178 and/or the alignment indicia or keys 191 (e.g., 193 and 195) align with one another. It should be noted that although two hollow rotor sections 169 (e.g., the first section 190 and the second section 192) are shown in FIG. 6, any number of hollow rotor sections 169 may be coupled together to obtain a desired length of the hollow rotor 158. Indeed, the length of the hollow rotor 158 may depend on a depth of a wellbore, operating parameters, and/or other circumstances or conditions. In certain embodiments, the hollow rotor sections 169 may have a uniform geometry and material construction, such that the hollow rotor sections 169 may incrementally add to the overall length of the hollow rotor 158. However, in some embodiments, the hollow rotor sections 169 may have a different geometry and/or material construction, such as differing axial lengths (e.g., length of L, 2L, 3L, 4L, etc.), to provide more flexibility in assembling an overall length of the hollow rotor 158. However, each hollow rotor section 169 may have a maximum length due to manufacturing constraints and/or a desire for modularity in constructing different hollow rotors 158. In some embodiments, the hollow rotor sections 169 may have different wall thicknesses, material construction, wear resistance, corrosion resistance, spiral or helical shapes (e.g., angle of spiral), or any combination thereof, such that the hollow rotor sections 169 can be assembled in a manner that progressively changes characteristics of the hollow rotor 158 lengthwise along the hollow rotor 158. In some embodiments, one or more additional components may be installed at the intermediate joint 171 between adjacent hollow rotor sections 169, such as a rotational support or bearing.

Figure 7:
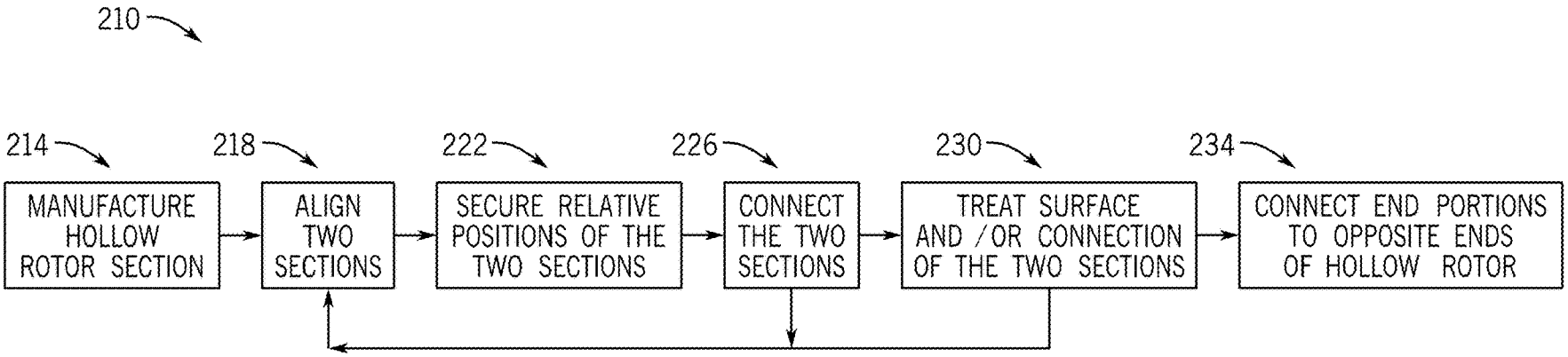
FIG. 7 is a block diagram of a process for manufacturing the hollow rotor of FIGS. 1-6, in accordance with embodiments described herein.

FIG. 7 illustrates a flow diagram of a process 210 for manufacturing an embodiment of the hollow rotor 158. Beginning at block 214, a hollow rotor section 169 of the hollow rotor 158 may be manufactured by any suitable manufacturing technique, such as casting, molding, additive manufacturing, hydroforming, extruding, twisting or bending, or any combination thereof. For example, the hollow rotor section 169 of the hollow rotor 158 may be hydroformed in a method as described above.

Moving to block 218, multiple hollow rotor sections 169 of the hollow rotor 158 may be aligned as described in detail above. That is, a first section and a second section of the hollow rotor 158 may be positioned to contact an end of the first section with an end of the second section. An alignment tool 178 may be positioned proximate to both the first section and the second section, overlapping a contact point. The first section, the second section, or both may be axially rotated, relative to an axis extending through the lengths of the first section and second section, until each rotor crest and/or rotor trough (e.g., each rotor crest and/or rotor trough within the alignment length of the alignment tool) is aligned (e.g., substantially matches) with a respective alignment crest and/or alignment trough of the alignment tool. In this way, upon coupling the first and second sections, the combined sections will include a consistent spiral or helical shape throughout the length of the hollow rotor 158. In some embodiments, three or more hollow rotor sections 169 may be aligned to manufacture a desired length of the hollow rotor 158.

Moving now to block 222, each hollow rotor section 169 may be secured in the aligned position. For example, the first section and the second section may be mechanically clamped using, for example, hand clamps, pipe clamps, bar clamps, and/or any other suitable method. In this way, the contact point between the first section and the second section may be secured for coupling.

After securing the first and second sections in a manner as described in block 222, the first and second sections may be connected in block 226. That is, the end of the first section in contact with the end of the second section at the contact point may be coupled together to create one continuous spirally or helically shaped hollow rotor 158. The first and second sections may be coupled together by any suitable connection, such as welding, brazing, mechanical attachment methods (e.g., fasteners, threaded screws, threaded bolts, etc.), chemical adhesives, and/or any other suitable methods.

Following connection of the first and second sections of the hollow rotor 158 in block 226, the connection may be treated in block 230. For example, in embodiments where the first and second sections are welded together, the connection (e.g., welded connection) may be treated with various steps or processes, such as, removing weld spatter, grinding the weld, cleaning the weld (e.g., cleaning with solvents, degreasers, wire brush, etc.), heating the weld post-weld, applying surface finishing and/or coating (e.g., galvanizing, carbon coating, chrome coating, or any protective coating), and other suitable treatment methods. For example, the protective coating may include one or more wear resistant coatings, corrosion resistant coatings, low friction coatings, or any combination thereof.

It should be noted that before, during, and/or after blocks 226 and 230, the process 210 may return to block 218. For example, in an embodiment, after connecting the first and second sections, the connected first and second sections may be aligned with a third section, where the process 210 may then continue again to block 222. In certain embodiments, after the connection between the first and second sections is treated in block 230, the first and second sections may be aligned with a third section, where the process 210 may then continue again to block 222.

Referring now to block 234, end portions may be connected to the connected first and second sections of the hollow rotor 158. For example, a rotor head may be connected to one end of the connected first and second sections and a cap may be connected to a second end of the connected first and second sections. The rotor head and cap may be coupled together by any suitable connection, such as welding, brazing, mechanical attachment methods (e.g., fasteners, threaded screws, threaded bolts, etc.), chemical adhesives, and/or any other suitable method. Although the process 210 illustrates block 234 after block 230, it should be appreciated connecting the rotor head and cap may occur at any time during process 210. For example, the rotor head may be connected to the first section and the cap may be connected to the second section before connecting the first and second sections.

The technical effect of the disclosed embodiments include a reduced vibration and an increased operational speed of a pump 132 having a rotor 116 (e.g., hollow rotor 158) and a stator 118 (e.g., composite stator). For example, the hollow construction of the rotor 116 substantially reduces the weight and vibration associated with rotation of the rotor 116, and thus the rotor 116 is able to rotate over a much wider range of rotational speeds, such as between 0 to 1500 RPM, 10 to 1400 RPM, 20 to 1300 RPM, 30 to 1200 RPM, 40 to 1100 RPM, or 50 to 1000 RPM. An advantage of the wider range of rotational speeds, as compared with pumps having a solid rotor, is the ability to use the same pump for both low speed applications and high speed applications rather than changing pumps. The ability to use one pump rather than two different pumps also avoids downtime associated with changing pumps, and allows for more rapid response to changes in pumping needs. The reduced vibration also increases the durability and operational lifetime of the pump 132.

The subject matter described in detail above may be defined by one or more clauses, as set forth below.

A system comprising an electric submersible progressive cavity pump (ESPCP), the ESPCP including a stator having an internal bore, and a hollow rotor disposed in the internal bore of the stator, where the hollow rotor is configured to rotate within the internal bore to pump a fluid via a plurality of progressive cavities.

The system of any preceding clause, comprising a hydrocarbon extraction system having the ESPCP.

The system of any preceding clause, where the ESPCP has an operating range between a lower rotational speed to an upper rotational speed of the hollow rotor rotating within the internal bore of the stator, wherein the upper rotational speed is equal to or greater than 1000 RPM.

The system of any preceding clause, where the lower rotational speed is equal to or less than 100 RPM.

The system of any preceding clause, where the ESPCP comprises an electric motor coupled to the hollow rotor.

The system of any preceding clause, where the ESPCP comprises a vortex gas separator assembly.

The system of any preceding clause, where the hollow rotor comprises a spiral shell disposed about a hollow interior.

The system of any preceding clause, where the hollow rotor comprises a plurality of hollow rotor sections coupled together.

The system of any preceding clause, where each hollow rotor section of the plurality of hollow rotor sections are the same as one another.

The system of any preceding clause, where the plurality of hollow rotor sections are different from one another.

The system of any preceding clause, where the hollow rotor comprises a rotor head and a cap coupled to opposite axial ends of the hollow rotor.

The system of any preceding clause, comprising one or more coatings disposed over an exterior of the hollow rotor including one or more welded joints between the plurality of hollow rotor sections.

The system of any preceding clause, further comprising an alignment tool, one or more alignment indicia or keys on the plurality of hollow rotor sections, or a combination thereof, configured to align the plurality of hollow rotor sections during assembly of the hollow rotor.

The system of any preceding clause, where the stator comprises a composite material having a plurality of elements distributed in a matrix material.

The system of any preceding clause, where the composite material is disposed between an outer wall and an inner wall of the stator, the inner wall comprises the internal bore of the stator, the outer wall comprises a metal, the inner wall comprises an elastomer, and the matrix material comprises a polymer.

A method including operating an electric submersible progressive cavity pump (ESPCP), where the ESPCP comprises a stator having an internal bore and a hollow rotor disposed in the internal bore of the stator, and controlling the ESPCP over an operating range between a lower rotational speed to an upper rotational speed of the hollow rotor rotating within the internal bore of the stator, where the upper rotational speed is equal to or greater than 1000 RPM.

The method of any preceding clause, where the lower rotational speed is equal to or less than 100 RPM.

A method including assembling a hollow rotor of an electric submersible progressive cavity pump (ESPCP), and installing the hollow rotor within an internal bore of a stator of the ESPCP, where the hollow rotor is configured to rotate within the internal bore to pump a fluid via a plurality of progressive cavities.

The method of any preceding clause, wherein assembling the hollow rotor comprises aligning a plurality of hollow rotor sections of the hollow rotor and coupling together the plurality of hollow rotor sections via one or more intermediate joints.

The method of any preceding clause, comprising constructing the stator with a composite material having a plurality of elements distributed in a matrix material.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

an electric submersible progressive cavity pump (ESPCP), comprising: a stator having an internal bore; and a hollow rotor disposed in the internal bore of the stator, wherein the hollow rotor is configured to rotate within the internal bore to pump a fluid via a plurality of progressive cavities, wherein the hollow rotor includes an outer shell, the outer shell having a thickness between a helical-shaped outer wall and an inner wall, the inner wall defining an interior space filled with an inert gas and sealed to prevent ingress of fluid into the interior space.

2. The system of claim 1, further comprising a hydrocarbon extraction system having the ESPCP.

3. The system of claim 1, wherein the ESPCP has an operating range between a lower rotational speed to an upper rotational speed of the hollow rotor rotating within the internal bore of the stator, wherein the upper rotational speed is equal to or greater than 1000 RPM.

4. The system of claim 3, wherein the lower rotational speed is equal to or less than 100 RPM.

5. The system of claim 4, wherein the ESPCP comprises an electric motor coupled to the hollow rotor.

6. The system of claim 4, wherein the ESPCP comprises a vortex gas separator assembly.

7. The system of claim 1, wherein the hollow rotor comprises a plurality of hollow rotor sections coupled together.

8. The system of claim 7, wherein each hollow rotor section of the plurality of hollow rotor sections are the same as one another.

9. The system of claim 7, further comprising an alignment tool, one or more alignment indicia or keys on the plurality of hollow rotor sections, or a combination thereof, configured to align the plurality of hollow rotor sections during assembly of the hollow rotor.

10. The system of claim 1, wherein the stator comprises a composite material having a plurality of elements distributed in a matrix material.

11. The system of claim 10, wherein the composite material is disposed between an outer wall and an inner wall of the stator, the inner wall comprises the internal bore of the stator, the outer wall comprises a metal, the inner wall comprises an elastomer, and the matrix material comprises a polymer.

12. A method, comprising:

operating an electric submersible progressive cavity pump (ESPCP), wherein the ESPCP comprises a stator having an internal bore and a hollow rotor disposed in the internal bore of the stator, wherein the hollow rotor includes an outer shell, the outer shell having a thickness between a helical-shaped outer wall and an inner wall, the inner wall defining an interior space filled with an inert gas and sealed to prevent ingress of fluid into the interior space; and controlling the ESPCP over an operating range between a lower rotational speed to an upper rotational speed of the hollow rotor rotating within the internal bore of the stator, wherein the upper rotational speed is equal to or greater than 1000 RPM.

13. The method of claim 12, wherein the lower rotational speed is equal to or less than 100 RPM.

14. A method, comprising:

assembling a hollow rotor of an electric submersible progressive cavity pump (ESPCP), wherein the hollow rotor includes an outer shell, the outer shell having a thickness between a helical-shaped outer wall and an inner wall, the inner wall defining an interior space filled with an inert gas and sealed to prevent ingress of fluid into the interior space; and installing the hollow rotor within an internal bore of a stator of the ESPCP, wherein the hollow rotor is configured to rotate within the internal bore to pump a fluid via a plurality of progressive cavities.

15. The method of claim 14, wherein assembling the hollow rotor comprises:

aligning a plurality of hollow rotor sections of the hollow rotor; and coupling together the plurality of hollow rotor sections via one or more intermediate joints.

16. The method of claim 14, further comprising constructing the stator with a composite material having a plurality of elements distributed in a matrix material.

17. The system of claim 1, wherein the interior space is sealed with an end cap.

18. The system of claim 8, wherein adjacent hollow rotor sections of the plurality of hollow rotor sections are internally open.

* * * * *